US009062885B2

(12) United States Patent
Takami et al.

(10) Patent No.: US 9,062,885 B2
(45) Date of Patent: Jun. 23, 2015

(54) FUEL NOZZLE, GAS TURBINE COMBUSTOR WITH THE SAME, AND GAS TURBINE WITH THE SAME

(75) Inventors: Eiji Takami, Minato-ku (JP); Katsunori Tanaka, Minato-ku (JP); Koichi Nishida, Minato-ku (JP); Shinji Akamatsu, Minato-ku (JP); Hideki Haruta, Minato-ku (JP); Tomo Kawakami, Minato-ku (JP); Kei Inoue, Minato-ku (JP)

(73) Assignee: MITSUBISHI HITACHI POWER SYSTEMS, LTD., Yokohama-shi (JP)

( * ) Notice: Subject to any disclaimer, the term of this patent is extended or adjusted under 35 U.S.C. 154(b) by 900 days.

(21) Appl. No.: 13/216,966

(22) Filed: Aug. 24, 2011

(65) Prior Publication Data

US 2012/0180490 A1 Jul. 19, 2012

(30) Foreign Application Priority Data

Jan. 14, 2011 (JP) ..... 2011-006026

(51) Int. Cl.
*F23R 3/28* (2006.01)
*B05B 15/00* (2006.01)
(Continued)

(52) U.S. Cl.
CPC ... *F23R 3/14* (2013.01); *F23R 3/28* (2013.01); *F23R 3/36* (2013.01)

(58) Field of Classification Search
CPC ..... F02C 7/22; F23R 3/14; F23R 3/28; F23R 3/36; F05D 2240/36
USPC ..... 60/740, 742, 748; 239/132.3, 132.5, 239/406
See application file for complete search history.

(56) References Cited

U.S. PATENT DOCUMENTS 5,351,489 A * 10/1994 Okamoto et al. ..... 60/740
2007/0006587 A1* 1/2007 Ohta et al. ..... 60/748
2007/0033919 A1* 2/2007 Tanimura et al. ..... 60/740

FOREIGN PATENT DOCUMENTS

JP 56-14829 A 2/1981
JP 05-172331 A 7/1993
JP 06066156 A * 3/1994 ..... F02C 3/30
(Continued)

OTHER PUBLICATIONS

International Search Report of PCT/JP2011/068608, date of issued Oct. 11, 2011.
(Continued)

*Primary Examiner* — J. Gregory Pickett
(74) *Attorney, Agent, or Firm* — Westerman, Hattori, Daniels & Adrian, LLP

(57) ABSTRACT

A fuel nozzle for a gas turbine combustor includes: an internal cylinder; a burner cylinder concentrically provided on the outer circumference of the internal cylinder in the vicinity of its distal end to surround the distal end portion of the internal cylinder; an air passage provided between the burner cylinder and the internal cylinder for delivering combustion air; a space provided at an axial center of the internal cylinder and extending in the axial direction of the internal cylinder; a plurality of inner passages provided at approximately equal intervals in the circumferential direction of the internal cylinder for injecting fluid through its distal end portion; and at least one communication portion provided on the upstream side of the distal end portion of the internal cylinder and extending from the outer wall of the internal cylinder toward the inner side in the radial direction to communicate with the space.

16 Claims, 5 Drawing Sheets

(51) Int. Cl.
*F23R 3/14* (2006.01)
*F23R 3/36* (2006.01)

(56) References Cited

FOREIGN PATENT DOCUMENTS

| | | | | | |
|---|---|---|---|---|---|
| JP | 10-002558 | A | | 1/1998 | |
| JP | 10-205757 | A | | 8/1998 | |
| JP | 2000-039147 | A | | 2/2000 | |
| JP | 2002-71135 | A | | 3/2002 | |
| JP | 2002156115 | A | * | 5/2002 | ..... F23R 3/00 |
| JP | 2003247425 | A | * | 9/2003 | ..... F02C 7/232 |
| JP | 2005-195284 | A | | 7/2005 | |
| JP | 2007-046886 | A | | 2/2007 | |
| WO | 98/33012 | A1 | | 7/1998 | |

OTHER PUBLICATIONS

Decision to Grant a Patent dated Jun. 18, 2014, issued in corresponding Korean Patent Applicaation No. 10-2012-7031041, Decision to Grant a Patent has been received (2 pages).
Decision to Grant a Patent dated Sep. 9, 2014, issued in corresponding Japanese Application No. 2011-006026. (3 pages).
Notice of Allowance dated Apr. 15, 2015, issued in corresponding Chinese Application No. 201180035246.7. (2 pages) "The Notice of Allowance has been received."

* cited by examiner

FUEL NOZZLE, GAS TURBINE COMBUSTOR WITH THE SAME, AND GAS TURBINE WITH THE SAME

CROSS-REFERENCE TO RELATED APPLICATIONS

This application is based on Japanese Patent Application No. 2011-006026, the contents of which are incorporated herein by reference.

BACKGROUND OF THE INVENTION

1. Field of the Invention

The present invention relates to a fuel nozzle, a gas turbine combustor with the same, and a gas turbine with the same. More particularly, the present invention relates to cooling a dual fuel nozzle used by switching between oil and gas.

2. Description of Related Art

A gas turbine combustor in a gas turbine may be provided to burn gas fuel or oil fuel by switching between the gas fuel and the oil fuel, in which the oil fuel, the gas fuel, and combustion air are delivered. Hot combustion gas generated by burning the fuel in the gas turbine combustor is delivered into the gas turbine to drive the gas turbine. At the start of combustion, the oil fuel or the gas fuel may be delivered into a fuel nozzle disposed at the axial center of the gas turbine combustor for ignition.

Here, the fuel nozzle is arranged in the gas turbine combustor so that the axial direction of an approximately cylindrical fuel nozzle body is the same as the direction of air flow in the gas turbine combustor. In the approximately cylindrical fuel nozzle body, gas fuel passages are provided at almost equal intervals in its circumferential direction. Also, a circular air passage is provided between an external cylinder covering the outer circumference of the fuel nozzle body and the outer circumferential wall of the fuel nozzle body.

The fuel nozzle formed as described above injects the incoming air from the air passage approximately obliquely inward toward the axial center of the fuel nozzle body from an air injection port provided in the vicinity of a distal end portion of the fuel nozzle so as to deliver the air into the gas turbine combustor.

The gas fuel delivered to the distal end portion of the fuel nozzle through the gas fuel passage is injected approximately obliquely outward toward the axial center of the fuel nozzle body from a gas injection port provided in the vicinity of the distal end portion.

The oil fuel is delivered through an oil fuel nozzle accommodated in a cylindrical space formed by the inner wall of the approximately cylindrical fuel nozzle body and is injected into the gas turbine combustor from an injection port provided at the center of a distal end portion of the oil fuel nozzle.

Thus, the air and the gas fuel or the oil fuel are burnt by being injected into the gas turbine combustor from the distal end portion of the fuel nozzle and are ignited.

At the distal end portion of the fuel nozzle, hot air delivered from the air passage is injected while the gas fuel with a lower temperature than the air delivered from the gas fuel passage formed to closer to the axial center of the fuel nozzle than the air passage is injected. Therefore, the difference in temperature between the outer circumferential side (the side close to the air passage) and the inner circumferential side (the side close to the gas fuel passage) of the fuel nozzle body sandwiched between the gas fuel passage and the air passage becomes large, which causes the difference in thermal elongation. Thus, a crack may be generated on a welded portion of the distal end portion of the fuel nozzle.

When only the gas fuel is used, the oil fuel nozzle is removed. Accordingly, a cylindrical space along the central line in the axial direction of the fuel nozzle, which is generated by removing the oil fuel nozzle, is exposed to the hot combustion gas. A cap for sealing the space from the distal end portion of the fuel nozzle is provided to prevent a crack generated on the welded portion of the distal end portion of the fuel nozzle due to the hot fuel gas introduced into the space. The cap is exposed to the hot combustion gas, and thus needs to be cooled (for example, Japanese Unexamined Patent Application, Publication No. Hei 10-205757).

In order to cool the cap provided on the distal end portion of the fuel nozzle, air may be introduced into the cap from an external air system.

Japanese Unexamined Patent Application, Publication No. 2002-71135 discloses cooling the cap by deflecting air compressed by a compressor provided in a gas turbine to deliver the air into the space of the fuel nozzle and by effusing the air from the distal end portion of the fuel nozzle through an effusion hole provided on a distal end surface of the cap from the space.

However, when air is introduced into the cap from the external air system to cool the cap, pipes or the like for introducing the outer air are complicated.

In the invention disclosed in Japanese Unexamined Patent Application, Publication No. 2002-71135, the oil fuel nozzle is removed when only the gas fuel is used and then the cap formed with an air passage for cooling is required to be provided on the distal end portion of the fuel nozzle. Thus, considerable cost is required.

The present invention has been made in view of the above-described circumstances. It is an object to provide a fuel nozzle capable of easily cooling a distal end portion of the fuel nozzle at low cost, and a gas turbine combustor with the fuel nozzle, and a gas turbine with the gas turbine combustor.

BRIEF SUMMARY OF THE INVENTION

The aforementioned object is achieved by the following solutions.

A fuel nozzle according to an aspect of the present invention includes: an internal cylinder basket; a burner cylinder concentrically provided on an outer circumference of the internal cylinder in the vicinity of its distal end to surround a distal end portion of the internal cylinder; an air passage provided between the burner cylinder and the internal cylinder for delivering combustion air; a space provided at the axial center of the internal cylinder and extending in the axial direction of the internal cylinder; a plurality of inner passages provided at approximately equal intervals in the circumferential direction of the internal cylinder for injecting fluid through a distal end portion; and at least one communication portion provided on an upstream side of the distal end portion of the internal cylinder and extending from an outer wall of the internal cylinder toward an inner side in the radial direction to communicate with the space, in which part of the combustion air passing through the air passage is delivered into the space through the communication portion and is discharged from a distal end portion of the space.

When a dual fuel nozzle switching between gas fuel and oil fuel is used, hot combustion air extracted by a compressor of a gas turbine is delivered into the air passage and gas fuel (fluid) with a lower temperature than the combustion air is delivered through gas fuel passages (inner passages) provided on the inner side of the air passage. Accordingly, in the internal cylinder sandwiched between the air passage and the gas fuel passages, the temperature on the outer wall side close to the air passage and the temperature on the inner wall side close to the gas fuel passages are considerably different. Thus, the difference in thermal elongation is generated between the outer wall side and the inner wall side of the internal cylinder and the thermal stress is applied on a welded portion connecting the outer wall side and the inner wall side of the internal cylinder at the distal end portion of the fuel nozzle, so that a crack is easily generated on the welded portion.

Therefore, according to the aspect of the present invention, part of the combustion air passing through the air passage is discharged from the distal end portion of the space provided in the internal cylinder. The combustion air discharged from the distal end portion of the space cools the distal end portion of the fuel nozzle due to the film cooling effect. With the simple structure in which the communication portion for introducing the combustion air into the space is provided in the internal cylinder, the cooling can be performed by the fuel nozzle alone. Thus, additional components for converting or cooling the distal end portion of the fuel nozzle are not required. Consequently, the cost for cooling the fuel nozzle can be suppressed.

The fuel nozzle according the aspect of the present invention may include a turning blade provided in a middle of the air passage in the axial direction and giving a turning force to the combustion air to form a turning air flow in which the communication portion may be provided on the upstream side of the turning blade.

The communication portion for introducing part of the combustion air into the space is provided on the upstream side of the turning blade provided inside the burner cylinder in the flow of the combustion air. Since the pressure of the combustion air is considerably different before and after the turning blade, the combustion air can be delivered into the space of the fuel nozzle due to the pressure difference. Consequently, the fuel nozzle can be cooled efficiently.

In the fuel nozzle according to the aspect of the present invention, at least one cross-sectional shape of the communication portion orthogonal to its extending direction may have a long axis in the axial direction of the internal cylinder.

The cross-sectional shape of the communication portion orthogonal to the direction extending from the internal cylinder toward the space has the long axis in the axial direction of the internal cylinder. Accordingly, even when the cross-sectional shape of the communication portion is large, the amount of combustion air delivered into the space can be increased without interference between the communication portion and the gas fuel passages (inner passages). Thus, the fuel nozzle can be cooled more efficiently.

In the fuel nozzle according to the aspect of the present invention, the plurality of communication portions may be provided in the axial direction of the internal cylinder.

By providing the plurality of communication portions in the axial direction of the internal cylinder, the amount of combustion air delivered into the space can be increased. Thus, the fuel nozzle can be cooled more efficiently.

The fuel nozzle according to the aspect of the present invention may include: a circular return combustion air passage provided in the internal cylinder to be sandwiched between the inner passages and the space and extending in the axial direction of the internal cylinder; and a plurality of connection portions connecting the return combustion air passage and the air passage, in which a porous plate with a plurality of holes communicating with the space may be provided at a distal end of the space and a blocker closing the return combustion air passage may be provided at a distal end of the return combustion air passage.

The return combustion air passage is provided in the internal cylinder sandwiched between the inner passages and the space and is connected to the air passage through the plurality of connection portions. The blocker is provided at the distal end of the return combustion air passage to close the return combustion air passage, and the porous plate with the plurality of holes communicating with the space is provided at the distal end of the space. The combustion air passing through the space is discharged through the porous plate to impinge against the blocker, and then is delivered into the return combustion air passage. The combustion air delivered into the return combustion air passage is delivered into the air passage through the connection portions. After the distal end portion of the fuel nozzle is cooled by the combustion air impinging against the blocker from the porous plate, the combustion air used for cooling can be returned into the air passage. Thus, while the distal end portion of the fuel nozzle is cooled, the concentration of the fuel injected from the fuel nozzle can be prevented from increasing by cooling.

It is preferable that the diameter of the hole provided on the porous plate is 1 mm.

Due to the simple structure in which the porous plate is provided at the distal end of the space and the blocker is provided at the distal end of the return combustion air passage, the cost for cooling the fuel nozzle can be suppressed.

In the fuel nozzle according to the aspect of the present invention, a microporous plate with a plurality of micropores may be provided at a distal end of the space.

The microporous plate with the plurality of micropores is provided at the distal end of the space. Therefore, the combustion air passing through the micropores provided on the microporous plate from the space effuses out from the distal end portion of the fuel nozzle. Thus, the combustion air effused out from the microporous plate applies the film effect to the distal end portion of the fuel nozzle. Due to the simple structure in which the microporous plate is provided at the distal end of the space, the distal end portion of the fuel nozzle can be cooled.

It is preferable that the diameter of the micropore provided on the microporous plate is 1 mm.

A gas turbine combustor according to another aspect of the present invention includes the fuel nozzle as described above.

The fuel nozzle has a simple cooling structure at low cost. Thus, the occurrence of damage of the gas turbine combustor can be easily reduced at low cost.

A gas turbine according to yet another aspect of the present invention includes the gas turbine combustor as described above.

The gas turbine combustor can reduce the occurrence of damage easily at low cost. Thus, the damage occurred in the gas turbine when only gas fuel is used can be easily reduced at low cost.

In the fuel nozzle according to the present invention, part of combustion air delivered through the air passage is introduced into the space provided at the axial center of the internal cylinder, and is discharged from the distal end portion of the space. The combustion air discharged from the distal end portion of the space cools the distal end portion of the fuel nozzle due to the film cooling effect. Therefore, with this simple structure, the cooling can be performed by the fuel nozzle alone. Thus, additional components for converting or cooling the distal end portion of the fuel nozzle are not required. Consequently, the cost for cooling the fuel nozzle can be suppressed.

DETAILED DESCRIPTION OF THE INVENTION

[First Embodiment]

A pilot nozzle, in particular, as a fuel nozzle of a gas turbine according to a first embodiment of the present invention will be explained below with reference to FIG. 1A and FIG. 1B.

Figure 1A:
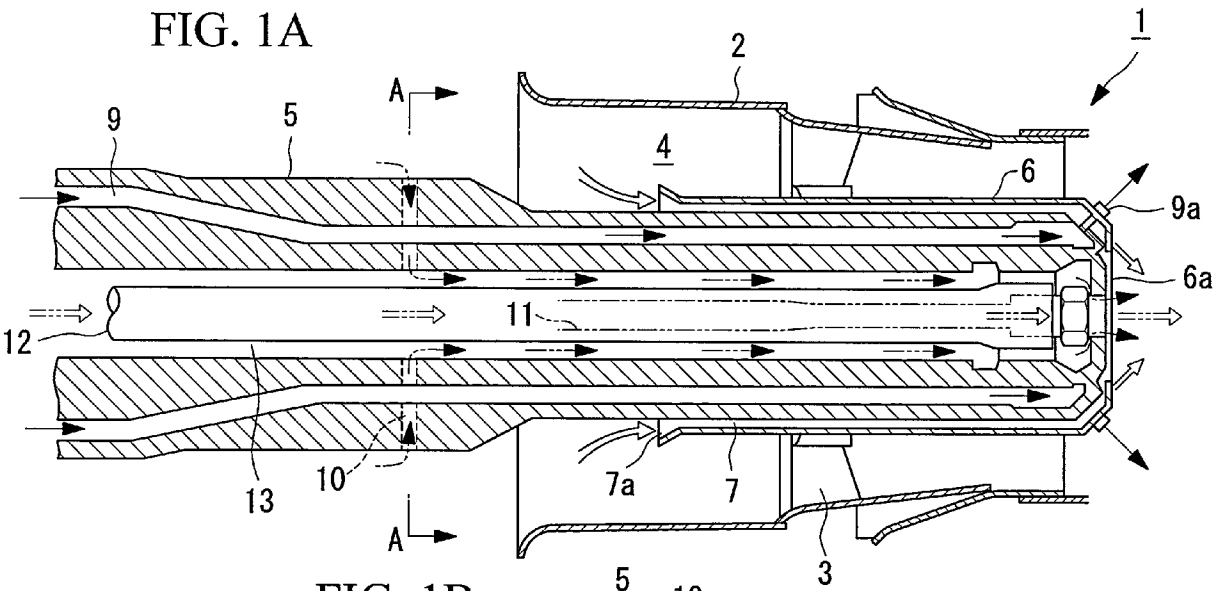
FIG. 1A is a schematic longitudinal cross-sectional view of a pilot nozzle of a combustor according to a first embodiment of the present invention.
Figure 1B:
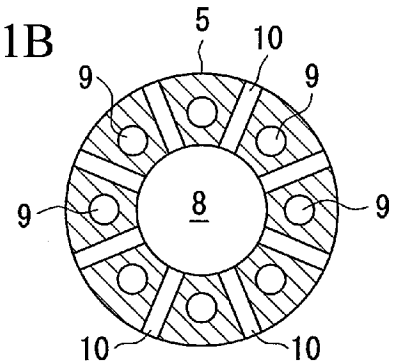
FIG. 1B is a transverse cross-sectional view showing the pilot nozzle of the combustor taken along the line A-A of FIG. 1A according to the first embodiment of the present invention.

FIG. 1A and FIG. 1B show the pilot nozzle provided in a combustor according to the first embodiment. FIG. 1A is a schematic longitudinal cross-sectional view, and FIG. 1B is a transverse cross-sectional view taken along the line A-A of FIG. 1A.

The gas turbine (not shown) including a gas turbine combustor (hereinafter referred to as "combustor") with the pilot nozzle (fuel nozzle) 1 according to the first embodiment includes a compressor (not shown) and a turbine (not shown) in addition to the combustor (not shown). The gas turbine usually includes a plurality of combustors. Combustion air compressed by the compressor is mixed with fuel delivered into each combustor to be burnt in each combustor, so that hot combustion gas is generated. The hot combustion gas is delivered into the turbine to rotate the turbine.

The plurality of combustors are arranged circularly in a combustor casing (not shown). The compressed combustion air is filled in the combustor casing and a gas turbine casing (not shown) to form a chamber (not shown). The combustion air compressed by the compressor is introduced into the chamber. The introduced combustion air is delivered into the combustor from an air inlet (not shown) provided on upstream of the combustor. In the combustor, the fuel delivered from the fuel nozzle (not shown) and the combustion air are mixed and burnt. Combustion gas generated by burning is delivered toward a turbine chamber (not shown) through a transition pipe (not shown) to rotate a turbine rotor (not shown).

The combustor includes a plurality of main nozzles (not shown) and one pilot nozzle 1.

The plurality of main nozzles are disposed to surround the circumference of the pilot nozzle 1 inside the combustor. Fuel injected from the main nozzles is premixed with the combustion air in advance, and is burnt inside a combustor body (not shown).

The pilot nozzle 1 includes an internal cylinder 5, a burner cylinder 2 concentrically provided on the outer circumference of the internal cylinder 5 in the vicinity of its distal end to surround a distal end portion of the internal cylinder 5, and turning vanes 3 as main elements.

Since the burner cylinder 2 is concentrically provided on the outer circumference of the internal cylinder 5 in the vicinity of its distal end to surround the distal end portion of the internal cylinder 5, a circular air passage 4 is formed between the burner cylinder 2 and the internal cylinder 5. Combustion air compressed by the compressor is delivered through the air passage 4 from the upstream side toward the downstream side.

The plurality of turning vanes 3 are radially arranged from the outer wall surface of the pilot nozzle 1 and disposed in the middle of the air passage 4 in the axial direction. Each turning blade 3 gives the turning force to the compressed combustion air delivered through the air passage 4 to make the combustion air form a turning air flow.

The pilot nozzle 1 mainly includes: the internal cylinder 5; an external cylinder 6 which is concentrically provided on the outer circumference of the internal cylinder 5 in the vicinity of its distal end to surround the distal end portion of the internal cylinder 5; a combustion air passage 7 which is provided between the external cylinder 6 and the internal cylinder 5 and through which the combustion air is delivered; a space 8 (see FIG. 1B) which is provided at the axial center of the internal cylinder 5 and extends in the axial direction of the internal cylinder 5; a plurality of gas fuel passages (inner passages) 9 which are provided at approximately equal intervals in the circumferential direction of the internal cylinder 5; and a plurality of (at least one) communication portions 10 which extend from the outer wall of the internal cylinder 5 toward the inner side in the radial direction to communicate with the space 8.

The external cylinder 6 is concentric with the internal cylinder 5, and has a base end portion (the right end in FIG. 1A) surrounding the distal end portion (the right end in FIG. 1A) of the internal cylinder 5. Therefore, the circular combustion air passage 7 is formed between the outer wall surface of the internal cylinder 5 and the inner wall surface of the external cylinder 6. In the combustion air passage 7, the compressed combustion air is delivered from the upstream side (the left side in FIG. 1A) toward the downstream side (the right side in FIG. 1A).

The burner cylinder 2 is concentrically provided on the outer circumference of the external cylinder 6, and the circular air passage 4 is formed between the outer wall surface of the external cylinder 6 and the inner wall surface of the burner cylinder 2. An introduction port 7*a* for introducing the combustion air into the combustion air passage 7 is opened on the upstream side of the turning vanes 3 in the middle of the air passage 4 in the axial direction.

The outer circumference of the internal cylinder 5 in the vicinity of its distal end portion is surrounded by the external cylinder 6. The cylindrical space 8 is formed at the axial center of the internal cylinder 5, into which an oil fuel nozzle 11 is inserted. The space 8 formed at the axial center of the internal cylinder 5 extends in the axial direction of the internal cylinder 5.

As shown in FIG. 1B, the plurality of gas fuel passages 9 (for example, eight gas fuel passages 9) through which the gas fuel (fluid) is delivered are provided at approximately equal intervals in the circumferential direction to center on the space 8. The plurality of gas fuel passages 9 extend in the axial direction of the internal cylinder 5 as well as the space 8.

The gas fuel is injected obliquely outward from a gas fuel injection hole 9*a* provided on the distal end portion of the internal cylinder 5 as shown by solid arrows in FIG. 1A. The gas fuel injected from the gas fuel injection hole 9*a* is mixed with the combustion air (shown by blank arrows in FIG. 1A), which is delivered from the combustion air passage 7 and is injected obliquely inward from a combustion air injection hole (not shown) provided on the distal end portion of the combustion air passage 7, and the combustion air delivered from the air passage 4 so as to be burnt in the combustor body.

As shown by a dashed-two dotted blank arrow in FIG. 1A, the oil fuel is injected into the combustor body by the oil fuel nozzle 11 through an oil fuel injection hole (not shown) provided on the distal end portion of the oil fuel nozzle 11 and an injection hole 6*a* provided on the external cylinder 6 surrounding the distal end portion of the internal cylinder 5. When the pilot nozzle 1 is used for exclusively burning gas (when the pilot nozzle 1 injects only the gas fuel), a dummy nozzle 12 is inserted into the space 8 provided at the axial center of the internal cylinder 5.

A predetermined clearance is formed between the distal end portion of the internal cylinder 5, the distal end portion of the oil fuel nozzle 11, and the distal end portion of the dummy nozzle 12. Air is delivered through the clearance.

The combustion air compressed by the compressor is introduced from the air inlet of the combustor into the combustor. A part of the combustion air is delivered from communication portions 10 into a circular passage 13 formed by inserting the oil fuel nozzle 11 into the space 8, and the rest of the combustion air is delivered into the air passage 4. The combustion air delivered from the communication portions 10 into the circular passage 13 is injected from the injection hole 6*a* on the distal end portion of the pilot nozzle 1. Since the turning vanes 3 are provided in the middle of the air passage 4 in the axial direction, the pressure of the combustion air on the upstream side of the turning vanes 3 is different from that on the downstream side of the turning vanes 3. In other words, the pressure of the combustion air on the downstream side of the turning vanes 3 is higher than that on the upstream side of the turning vanes 3. Thus, the compressed combustion air is easily delivered from the air passage 4 into the circular passage 13 through the introduction port 7*a* of the combustion air passage 7 and the communication portions 10.

Since a predetermined clearance is formed between the distal end portion of the internal cylinder 5 and the distal end portion of the oil fuel nozzle 11, the combustion air is delivered through the circular passage 13 from the upstream to the downstream in the extending direction of the internal cylinder 5 as shown by a solid dashed-two dotted line in FIG. 1A. The combustion air passing through the circular passage 13 is injected outside of the pilot nozzle 1 in the form of a film from the injection hole 6*a* provided on the distal end portion of the pilot nozzle 1.

Even when the pilot nozzle 1 is used for exclusively burning gas, the circular passage 13 is formed between the inner wall of the internal cylinder 5 and the dummy nozzle 12 by inserting the dummy nozzle 12 into the space 8 provided at the axial center of the internal cylinder 5.

The flow when the pilot nozzle 1 having the above-described structure is used for exclusively burning gas will be explained below with reference to FIG. 1A and FIG. 1B.

The oil fuel nozzle 11 inserted into the space 8 provided at the axial center of the internal cylinder 5 is removed. The dummy nozzle 12 is inserted into the space 8 from which the oil fuel nozzle 11 is removed. The dummy nozzle 12 has a structure that does not inject the oil fuel from its distal end portion. The circular passage 13 is formed between the outer wall of the dummy nozzle 12 and the inner wall of the internal cylinder 5.

When the pilot nozzle 1 including the dummy nozzle 12 is used for exclusively burning gas, the gas fuel delivered from the gas fuel passage 9 and the combustion air delivered through the combustion air injection hole are injected from the pilot nozzle 1. In other words, the gas fuel delivered from the gas fuel passage 9 is injected from the gas fuel injection hole 9*a* and is mixed with the combustion air delivered through the combustion air passage 7 and injected from the fuel air injection hole and the combustion air delivered from the air passage 4 so as to be burnt.

The combustion air delivered from the communication portions 10 into the circular passage 13 is injected from the injection hole 6*a* on the distal end portion of the pilot nozzle 1 as well as when the oil fuel nozzle 11 is inserted into the space 8.

Since a predetermined clearance is formed between the distal end portion of the internal cylinder 5 and the distal end portion of the dummy nozzle 12, the combustion air is delivered through the circular passage 13 from the upstream to the downstream in the extending direction of the internal cylinder 5 as shown by a solid dashed-two dotted line in FIG. 1A. The combustion air delivered through the circular passage 13 is injected in the form of a film outside of the pilot nozzle 1 from the injection hole 6*a* provided on the distal end portion of the pilot nozzle 1.

Since a cylindrical film air (combustion air layer) is delivered through the circular passage 13 and is injected from the injection hole 6*a*, the distal end portion of the pilot nozzle 1 is covered with the film air. Therefore, the temperature increase at the distal end portion of the pilot nozzle 1 can be prevented and the distal end portion of the pilot nozzle 1 can be cooled.

The amount of combustion air delivered from the communication portions 10 into the circular passage 13 is smaller than the amount of combustion air passing through the combustion air passage 7.

The pilot nozzle 1 according to the first embodiment as described above, the combustor with the pilot nozzle 1, and the gas turbine with the combustor have the following advantageous effects.

Even when the pilot nozzle (fuel nozzle) 1 is used for exclusively burning gas (when the pilot nozzle 1 injects only the gas fuel (fluid)), part of the combustion air is delivered through the combustion air passage 7 and is discharged from the distal end portion of the circular passage 13 formed by inserting the dummy nozzle 12 into the space 8 provided in the internal cylinder 5. The combustion air discharged from the distal end portion of the circular passage 13 cools the distal end portion of the pilot nozzle 1 due to the film cooling effect. Therefore, with the simple structure in which the communication portions 10 for introducing the combustion air into the circular passage 13 is provided in the internal cylinder 5, the cooling can be performed by the pilot nozzle 1 alone. Thus, additional components for converting or cooling the distal end portion of the pilot nozzle 1 are not required. Consequently, the cost for cooling the pilot nozzle 1 can be suppressed.

The communication portions 10 for introducing part of the combustion air into the space 8 is provided on the upstream side of the turning vanes 3 provided in the burner cylinder 2 in the flow of the combustion air. Since the pressure of the combustion air is considerably different before and after the turning vanes 3, the combustion air can be delivered into the space 8 of the pilot nozzle 1 by using the pressure difference. Thus, the pilot nozzle 1 can be efficiently cooled.

In the pilot nozzle 1, fuel may be supplied to the turning vanes 3 and injected into the combustion air from the surfaces of the turning vanes 3.

The pilot nozzle 1 has a simple cooling structure at low cost. Thus, the occurrence of damage of the combustor (gas turbine combustor) can be easily reduced at low cost.

The combustor (not shown) can reduce the occurrence of damage easily at low cost. Thus, the damage occurred in the gas turbine (not shown) when being used for exclusively burning gas can be easily reduced at low cost.

[Second Embodiment]

A pilot nozzle according to a second embodiment, a combustor with the pilot nozzle, and a gas turbine with the combustor are approximately the same as those according to the first embodiment except that a cross-sectional shape of a communication portion is different. Thus, the explanation of the same structure and the flow when the pilot nozzle is used for exclusively burning gas is omitted here.

Each (at least one) communication portion has an elliptical cross-sectional shape orthogonal to its extending direction having a long axis in the axial direction of the internal cylinder. In other words, the long axis of the cross-sectional shape of the communication portion is provided in the same direction as the extending direction of the gas fuel passage formed in the internal cylinder.

The pilot nozzle according to the second embodiment as described above, the combustor with the pilot nozzle, and the gas turbine with the combustor have the following advantageous effects.

The cross-sectional shape of the communication portion which is orthogonal to the extending direction of the communication portion from the internal cylinder toward the space is an elongated elliptical shape with a long axis in the axial direction of the internal cylinder. Accordingly, even when the cross-sectional shape of the communication portion is large, the amount of combustion air delivered into the space can be increased without interference between the communication portion and the gas fuel passage (inner passage). Thus, the pilot nozzle (fuel nozzle) can be cooled more efficiently.

In the second embodiment, the cross-sectional shape of the communication portion is elliptical, but is not limited thereto. The cross-sectional shape may be any shape having a long axis in the axial direction of the internal cylinder such as a rectangle shape.

Instead of providing the communication portion having the shape with a long axis in the axial direction of the internal cylinder, a plurality of communication portions may be provided in the axial direction of the internal cylinder to ensure a total cross-sectional area of the communication portions. Also, a combination of these shapes may be used.

When the plurality of communication portions are provided in the axial direction of the internal cylinder, the amount of combustion air introduced into the space can be further increased. Thus, the pilot nozzle can be cooled more efficiently.

[Third Embodiment]

A pilot nozzle according to a third embodiment, a combustor with the pilot nozzle, and a gas turbine with the combustor are approximately the same as those according to the first embodiment except that the internal cylinder includes a return combustion air passage between the space and the gas fuel passages in the second embodiment. Thus, the explanation of the same structure and the flow when the pilot nozzle is used for exclusively burning gas is omitted here. The same reference numerals are given without the explanation.

Figure 2A:
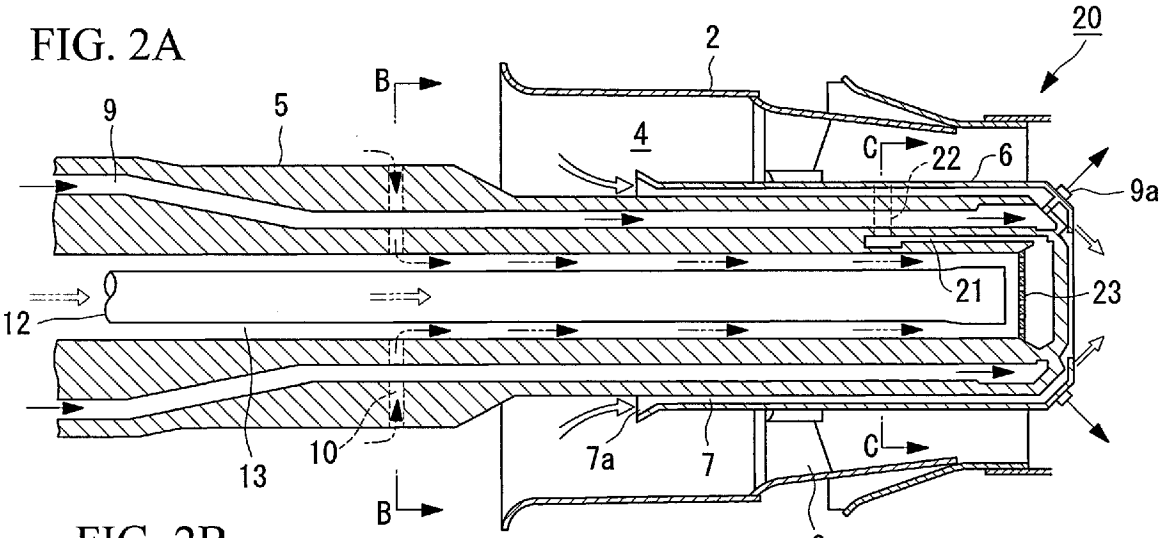
FIG. 2A is a schematic longitudinal cross-sectional view of a pilot nozzle of a combustor according to a third embodiment of the present invention.
Figure 2B:
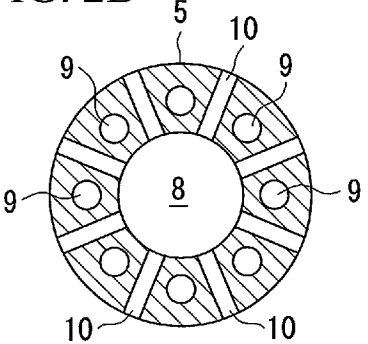
FIG. 2B is a transverse cross-sectional view showing the pilot nozzle of the combustor taken along the line B-B of FIG. 2A according to the third embodiment of the present invention.
Figure 2C:
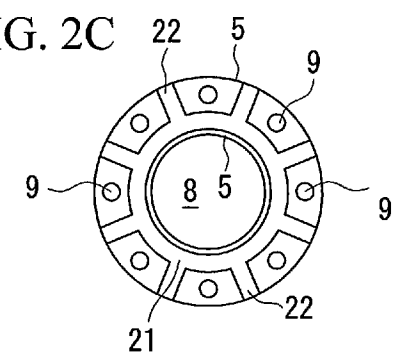
FIG. 2C is a transverse cross-sectional view showing the pilot nozzle of the combustor taken along the line C-C of FIG. 2A according to the third embodiment of the present invention.
Figure 3:
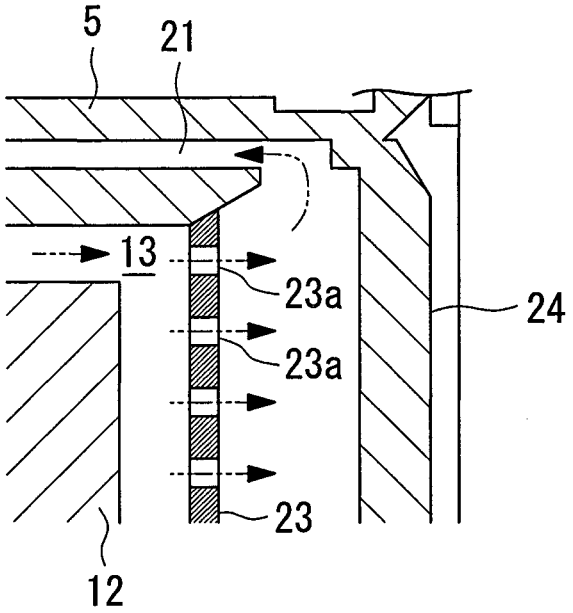
FIG. 3 is a schematic view showing a distal end portion of the pilot nozzle shown in FIG. 2A in a partially enlarged manner.

FIGS. 2A to 2C show the pilot nozzle provided in the combustor according to the third embodiment. FIG. 2A is a schematic longitudinal cross-sectional view of the pilot nozzle, FIG. 2B is a transverse cross-sectional view of the pilot nozzle taken along the line B-B of FIG. 2A, and FIG. 2C is a transverse cross-sectional view of the pilot nozzle taken along the line C-C of FIG. 2A. FIG. 3 is a schematic view showing the distal end portion of the pilot nozzle shown in FIG. 2A in a partially enlarged manner.

As shown in FIG. 2A, the pilot nozzle (fuel nozzle) 20 is provided on the internal cylinder 5 to be sandwiched between each gas fuel passage (inner passage) 9 and the space 8. The pilot nozzle 20 includes a circular return combustion air passage 21 extending in the axial direction of the internal cylinder 5, and a plurality of connection portions 22 (for example, eight connection portions 22) connecting the return combustion air passage 21 and the combustion air passage 7.

The return combustion air passage 21 is formed in the internal cylinder 5 between each gas fuel passage 9 and the space 8 in the vicinity of the distal end portion of the internal cylinder 5. As shown in FIG. 2C, the return combustion air passage 21 is a circular passage. The return combustion air passage 21 communicates with the space 8 at the distal end of the space 8.

The connection portions 22 connects the return combustion air passage 21 and the combustion air passage 7 in the radial direction of the internal cylinder 5. The return combustion air passage 21 and the combustion air passage 7 communicate with each other through the connection portions 22. As shown in FIG. 2C, each connection portion 22 is alternately provided between the gas fuel passages 9 in the circumferential direction of the internal cylinder 5. Each connection portion 22 has a structure that does not intersect with each gas fuel passage 9.

When the pilot nozzle 20 with such a structure is used for exclusively burning gas (when the pilot nozzle 20 injects only the gas fuel (fluid)), the dummy nozzle 12 is inserted into the space 8 provided at the axial center of the internal cylinder 5. As shown in FIG. 3, an impingement plate (porous plate) 23 with a plurality of holes 23*a* communicating with the circular passage 13 is provided on the distal end of the circular passage 13 formed by inserting the dummy nozzle 12 into the space 8. A closing plate (blocker) 24 for closing the return combustion air passage 21 is provided on the distal end of the return combustion air passage 21.

By providing the impingement plate 23 on the distal end of the circular passage 13, the combustion air passing through the circular passage 13 from the communication portions 10 (see FIG. 2A) is discharged from the plurality of holes 23*a* provided on the impingement plate 23. The combustion air discharged through the plurality of holes 23*a* provided on the impingement plate 23 impinges against the closing plate 24 closing the distal end of the return combustion air passage 21. Thus, the distal end of the pilot nozzle 20 is cooled. It is preferable that the diameter of the hole 23*a* provided on the impingement plate 23 is 1 mm.

Since the combustion air discharged through the plurality of holes 23*a* provided on the impingement plate 23 impinges against the closing plate 24, the flow direction thereof is changed. The combustion air of which the direction is changed is delivered into the return combustion air passage 21. The combustion air in the return combustion air passage 21 is delivered from the distal end portion of the internal cylinder 5 toward the base end side of the internal cylinder 5 (from the right side to the left side in FIG. 2A and FIG. 3), and delivered into the combustion air passage 7 through the connection portions 22.

The combustion air delivered into the combustion air passage 7 through the connection portions 22 merges with the combustion air delivered into the combustion air passage 7 through the introduction port 7*a*. The merged combustion air is injected from the combustion air injection hole (not shown) provided on the downstream side of the combustion air passage 7 and is mixed with the gas fuel injected from the gas fuel injection hole 9*a* so as to provide the fuel gas.

The pilot nozzle 20 according to the third embodiment as described above, the combustor with the pilot nozzle 20, and the gas turbine (not shown) with the combustor have the following advantageous effects.

The return combustion air passage 21 is provided in the internal cylinder 5 sandwiched between the gas fuel passages (inner passages) 9 and the space 8, and is connected to the combustion air passage 7 through the plurality of connection portions 22 (for example, eight connection portions 22). The closing plate (blocker) 24 is provided at the distal end of the return combustion air passage 21 to close the return combustion air passage 21, and the impingement plate (porous plate) 23 with the plurality of holes 23*a* communicating with the circular passage 13 is provided at the distal end of the circular passage 13 formed by inserting the dummy nozzle 12 into the space 8. Accordingly, the combustion air passing through the circular passage 13 is discharged through the impingement plate 23 to impinge against the closing plate 24 and is delivered into the return combustion air passage 21. The combustion air delivered into the return combustion air passage 21 is further delivered into the combustion air passage 7 through the connection portions 22. Therefore, after the distal end portion of the pilot nozzle (fuel nozzle) 20 is cooled by the combustion air impinging against the closing plate 24 from the impingement plate 23, the combustion air used for cooling can be returned into the combustion air passage 7. Thus, while the distal end of the pilot nozzle 20 is cooled, the concentration of the fuel injected from the pilot nozzle 20 is prevented from increasing by cooling.

Due to the simple structure in which the impingement plate 23 is provided at the distal end of the circular passage 13 and the closing plate 24 is provided at the distal end of the return combustion air passage 21, the cost for cooling the pilot nozzle 20 can be suppressed.

[Fourth Embodiment]

A pilot nozzle according to a fourth embodiment, a combustor with the pilot nozzle, and a gas turbine with the combustor are approximately the same as those according to the first embodiment except that a microporous plate is provided at the distal end of the internal cylinder. Thus, the explanation of the same structure and the flow when the pilot nozzle is used for exclusively burning gas is omitted here. The same reference numerals are given without the explanation.

Figure 4A:
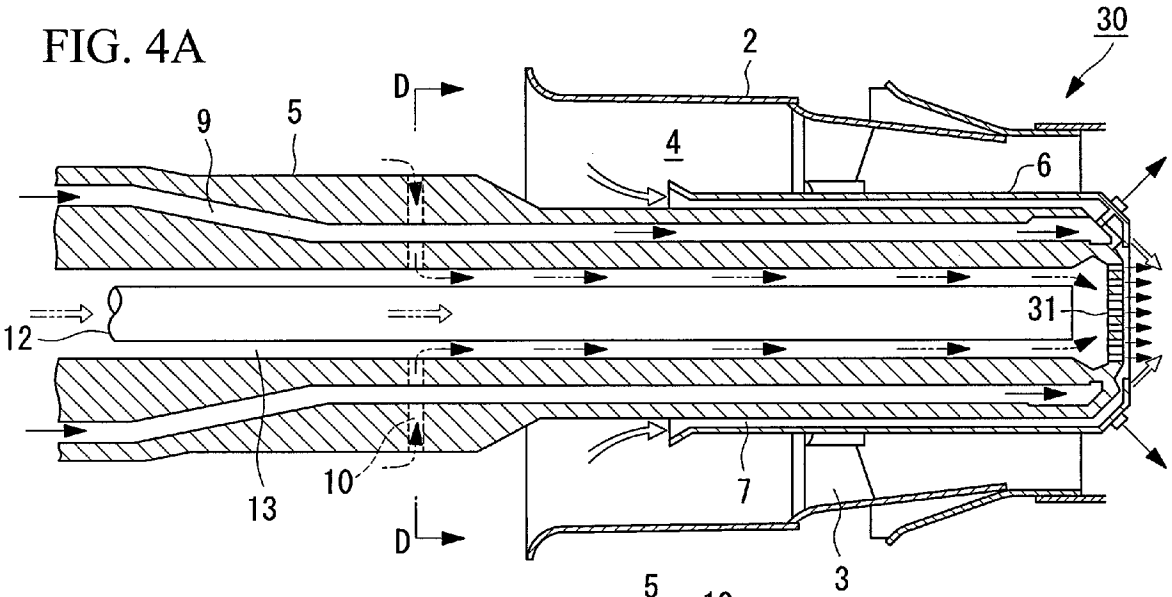
FIG. 4A is a schematic longitudinal cross-sectional view of a pilot nozzle of a combustor according to a fourth embodiment of the present invention.
Figure 4B:
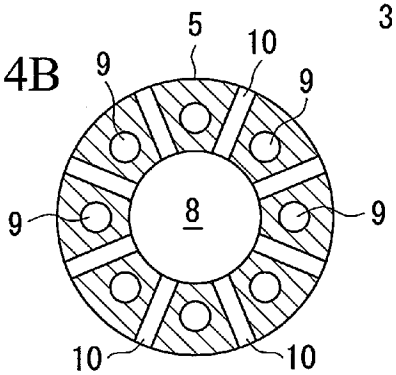
FIG. 4B is a transverse cross-sectional view showing the pilot nozzle of the combustor taken along the line D-D of FIG. 4A according to the fourth embodiment of the present invention.
Figure 5:
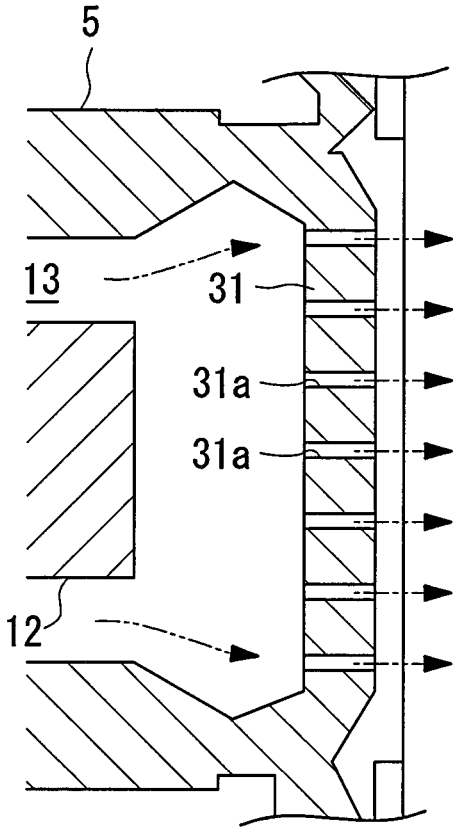
FIG. 5 is a schematic view showing a distal end portion of the pilot nozzle shown in FIG. 4A in a partially enlarged manner.

FIG. 4A and FIG. 4B show the pilot nozzle provided in the combustor according to the forth embodiment. FIG. 4A is a schematic longitudinal cross-sectional view of the pilot nozzle, and FIG. 4B is a transverse cross-sectional view of the pilot nozzle taken along the line D-D of FIG. 4A. FIG. 5 is a schematic view showing the distal end portion of the pilot nozzle shown in FIG. 4A in an enlarged manner.

When the pilot nozzle (fuel nozzle) 30 is used for exclusively burning gas (when the pilot nozzle 30 injects only the gas fuel (fluid)), the microporous plate 31 with a plurality of micropores 31*a* is provided at the end of the circular passage 13 formed by inserting the dummy nozzle 12 into the space 8.

It is preferable that the diameter of the micropore 31*a* provided on the microporous plate 31 is 1 mm.

The combustion air delivered through the circular passage 13 formed between the internal cylinder 5 and the dummy nozzle 12 effuses out from the distal end portion of the pilot nozzle 30 through the plurality of micropores 31*a* provided on the microporous plate 31, so that the distal end portion of the pilot nozzle 30 is cooled by the film cooling effect.

The pilot nozzle 30 according to the fourth embodiment as described above, the combustor with the pilot nozzle 30, and the gas turbine with the combustor have the following advantageous effects.

The microporous plate 31 with the plurality of micropores 31*a* is provided at the end of the circular passage 13 formed by inserting the dummy nozzle 12 into the space 8. Therefore, the combustion air passing through the micropores 31*a* provided on the microporous plate 31 from the circular passage 13 effuses out from the distal end portion of the pilot nozzle (fuel nozzle) 30. Thus, the combustion air effused out from the microporous plate 31 applies the film effect to the distal end portion of the pilot nozzle 30. Due to the simple structure in which the microporous plate 31 is provided at the distal end of the circular passage 13, the distal end portion of the pilot nozzle 30 can be cooled.

The present invention is not limited to the above-described embodiments, but can be changed or modified without departing from the scope of the present invention.

For example, although the gas fuel is delivered through the gas fuel passages 9 and the oil fuel is delivered through the oil fuel nozzle 11 in the embodiments, any fluid such as other fuels, vapor, water, or purge-air can be delivered depending on the situation. Also, an additional gas fuel nozzle may be provided instead of the oil fuel nozzle 11.

What is claimed is:

1. A fuel nozzle, comprising:

an internal cylinder;

a burner cylinder concentrically provided on an outer circumference of the internal cylinder in the vicinity of a distal end thereof to surround a distal end portion of the internal cylinder;

an air passage provided between the burner cylinder and the internal cylinder for delivering combustion air;

a space provided at an axial center of the internal cylinder and extending in an axial direction of the internal cylinder;

a plurality of inner passages provided at approximately equal intervals in a circumferential direction of the internal cylinder for injecting fluid through a distal end portion;

at least one communication portion provided on an upstream side of the distal end portion of the internal cylinder and extending from an outer wall of the internal cylinder toward an inner side in a radial direction to communicate with the space;

a circular return combustion air passage provided in the internal cylinder to be sandwiched between the inner passages and the space and extending in the axial direction of the internal cylinder; and a plurality of connection portions connecting the return combustion air passage and the air passage, wherein part of the combustion air passing through the air passage is delivered into the space through the communication portion and is discharged from a distal end portion of the space, and a porous plate with a plurality of holes communicating with the space is provided at a distal end of the space, and a blocker closing the return combustion air passage is provided at a distal end of the return combustion air passage.

2. The fuel nozzle according to claim 1 comprising a turning blade provided in a middle of the air passage in an axial direction and giving a turning force to the combustion air to form a turning air flow, wherein the communication portion is provided on an upstream side of the turning blade.

3. The fuel nozzle according to claim 1, wherein at least one cross-sectional shape of the communication portion orthogonal to an extending direction has a long axis in the axial direction of the internal cylinder.

4. The fuel nozzle according to claim 1, wherein a plurality of the communication portions are provided in the axial direction of the internal cylinder.

5. The fuel nozzle according to claim 1, wherein a microporous plate with a plurality of micropores is provided at a distal end of the space.

6. A gas turbine combustor comprising the fuel nozzle according to claim 1.

7. A gas turbine comprising the gas turbine combustor according to claim 6.

8. A fuel nozzle, comprising:

an internal cylinder;

a burner cylinder concentrically provided on an outer circumference of the internal cylinder in the vicinity of a distal end thereof to surround a distal end portion of the internal cylinder;

an air passage provided between the burner cylinder and the internal cylinder for delivering combustion air;

a space provided at an axial center of the internal cylinder and extending in an axial direction of the internal cylinder;

a plurality of inner passages provided at approximately equal intervals in a circumferential direction of the internal cylinder for injecting fluid through a distal end portion; and at least one communication portion provided on an upstream side of the distal end portion of the internal cylinder and extending from an outer wall of the internal cylinder toward an inner side in a radial direction to communicate with the space, wherein at the axial center of the internal cylinder, a circular passage is formed by inserting a cylindrical body into the space inside the internal cylinder, and part of the combustion air passing through the air passage is delivered into the circular passage through the communication portion and is injected from a distal end portion of the space.

9. The fuel nozzle according to claim 8, wherein when a gas fuel and an oil fuel is used for burning, an oil fuel nozzle which injects the oil fuel from its distal end portion to outside the internal cylinder is used as the cylindrical body, and when only the gas fuel is used for burning, a dummy nozzle which has a structure that does not inject the oil fuel from its distal end portion is used as the cylindrical body.

10. The fuel nozzle according to claim 9, wherein the oil fuel nozzle and the dummy nozzle is switched based on the selection of a dual burning mode using both the oil fuel and the gas fuel for burning and an exclusively gas burning mode using only the gas fuel for burning.

11. The fuel nozzle according to claim 8 comprising a turning blade provided in a middle of the air passage in an axial direction and giving a turning force to the combustion air to form a turning air flow, wherein the communication portion is provided on an upstream side of the turning blade.

12. The fuel nozzle according to claim 8, wherein at least one cross-sectional shape of the communication portion orthogonal to an extending direction has a long axis in the axial direction of the internal cylinder.

13. The fuel nozzle according to claim 8, wherein a plurality of the communication portions are provided in the axial direction of the internal cylinder.

14. The fuel nozzle according to claim 8, wherein a microporous plate with a plurality of micropores is provided at a distal end of the space.

15. A gas turbine combustor comprising the fuel nozzle according to claim 8.

16. A gas turbine comprising the gas turbine combustor according to claim 12.

* * * * *